US005224505A

United States Patent [19]

Wu

[11] Patent Number: 5,224,505

[45] Date of Patent: Jul. 6, 1993

[54] AUTOMATIC UMBRELLA WITH UPWARDLY AND DOWNWARDLY THRUSTED PUSH BUTTON

[75] Inventor: Tsun-Zong Wu, Taipei, Taiwan

[73] Assignee: Fu Tai Umbrella Works, Ltd., Taipei, Taiwan

[21] Appl. No.: 941,384

[22] Filed: Sep. 8, 1992

[51] Int. Cl.[5] ..... A45B 25/14

[52] U.S. Cl. ..... 135/24; 135/25.33; 135/25.41; 135/28; 135/39

[58] Field of Search ..... 135/22-24, 135/25.1, 25.33, 25.34, 25.4, 25.41, 28, 29, 30, 31, 37-42, 44

[56] References Cited

U.S. PATENT DOCUMENTS

| | | | |
|---|---|---|---|
| 2,725,888 | 12/1955 | Haupt | 135/38 |
| 3,658,077 | 4/1972 | Sato | 135/22 |
| 3,856,030 | 12/1974 | Sato | 135/24 X |
| 4,986,294 | 1/1991 | Wu | 135/22 |
| 5,058,613 | 10/1991 | Su et al. | 135/24 X |

FOREIGN PATENT DOCUMENTS

| | | | |
|---|---|---|---|
| 1370800 | 7/1964 | France | 135/38 |
| 982640 | 2/1965 | United Kingdom | 135/38 |
| 2218629 | 11/1989 | United Kingdom | 135/24 |

*Primary Examiner*—Richard E. Chilcot, Jr.
*Assistant Examiner*—Lan M. Mai

[57] ABSTRACT

An automatic umbrella includes: a central shaft, a plurality of umbrella ribs, an umbrella-opening spring, an umbrella-closing spring, and a control device having a push button which may be pushed upwardly for opening the umbrella and may be pushed downwardly for closing the umbrella for preventing a confusing or false operation when extending or folding the umbrella.

6 Claims, 4 Drawing Sheets

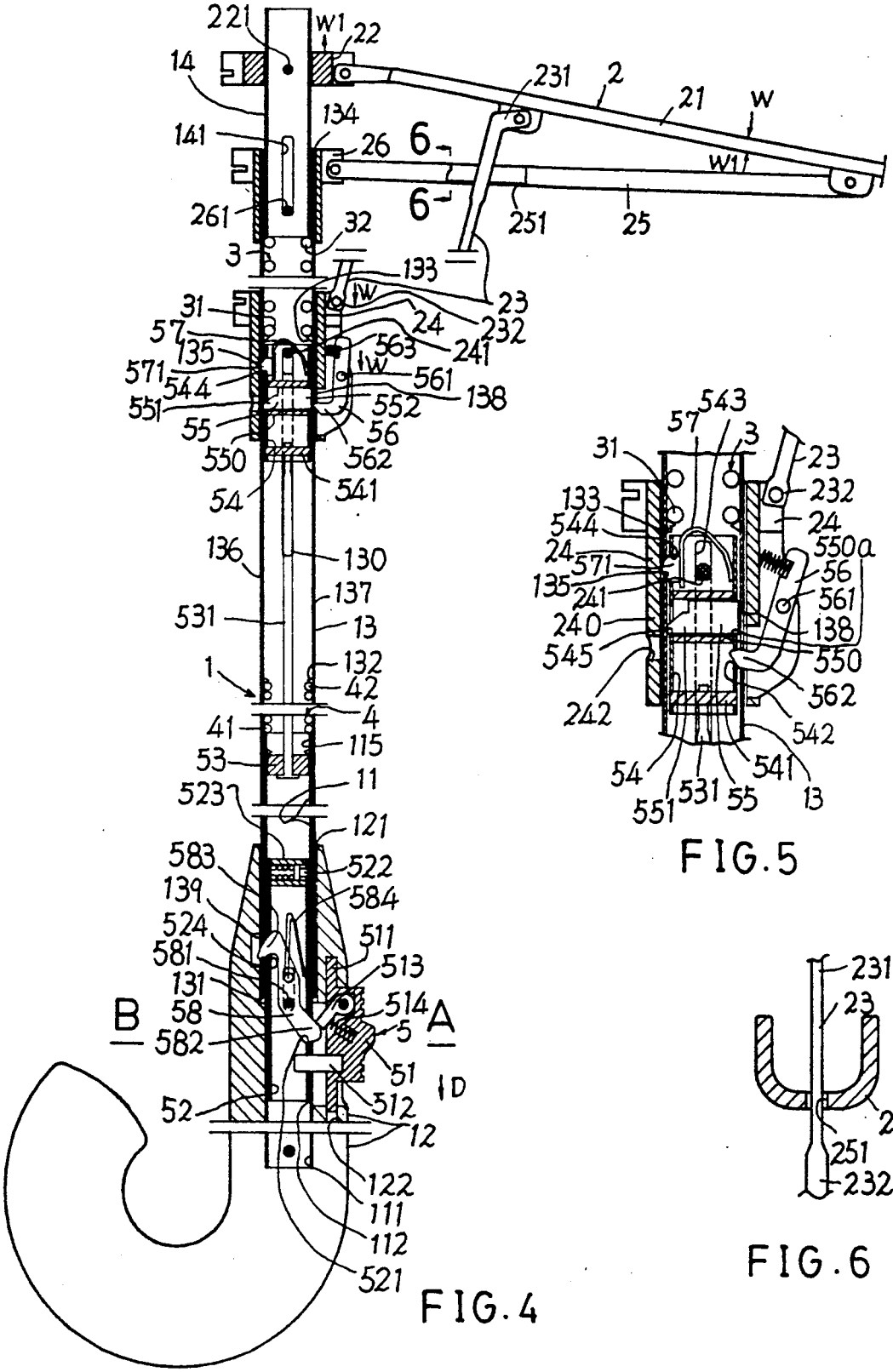
FIG.4
FIG.5
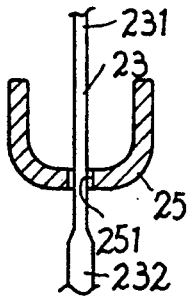
FIG.6

AUTOMATIC UMBRELLA WITH UPWARDLY AND DOWNWARDLY THRUSTED PUSH BUTTON

BACKGROUND OF THE INVENTION

A conventional automatic umbrella is provided with a push button having an upper button portion which is depressed for opening the umbrella and a lower button portion which is depressed for closing the umbrella. Whenever opening or closing the umbrella, the umbrella user should be very careful to watch the marking or position of the upper or lower button portion. Otherwise, he or she may depress the false button portion to influence the operation of the umbrella. If it is dark or at night time, the vision is too unclear to distinguish the location of the upper or lower button portion, confusing the umbrella opening or closing operation and causing inconvenience therefor.

The present inventor has found the drawbacks of a conventional automatic umbrella and invented the present umbrella for a clearer operation for opening or closing the umbrella.

SUMMARY OF THE INVENTION

The object of the present invention is to provide an automatic umbrella including a push button which may be pushed upwardly for opening the umbrella and may be pushed downwardly for closing the umbrella for preventing a confusing or false operation when extending or folding the umbrella.

BRIEF DESCRIPTION OF THE DRAWINGS

FIG. 4 is an illustration showing an opened umbrella of the present invention.

FIG. 5 is an illustration partially showing the umbrella condition when subjected to wind pressure.

FIG. 6 is a side view drawing when viewed from 6—6 direction as shown in FIG. 4.

DETAILED DESCRIPTION

Figure 1:
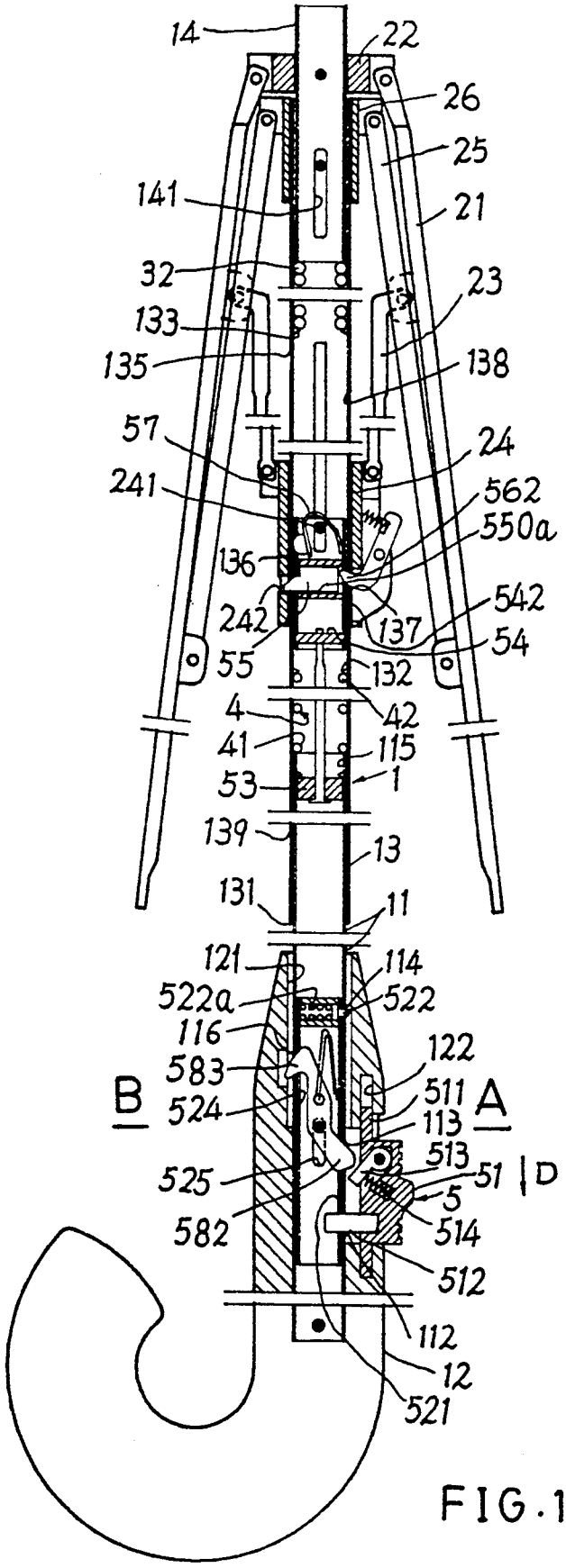
FIG. 1 is an illustration showing a closed umbrella of the present invention when folded from an opening umbrella.

As shown in FIGS. 1–6, the present invention comprises: a central shaft means 1, an umbrella rib means 2, an umbrella-opening spring 3, an umbrella-closing spring 4, and a control means 5.

The central shaft means 1 includes: an inner tube 11, a handle 12 secured with the inner tube 11, an outer tube 13 slidably jacketed on the inner tube 11, and a top sleeve 14 resiliently held in an upper portion of the outer tube 13.

The umbrella rib means 2 includes: a top rib 21 having an inner end portion of the top rib 21 pivotally secured on an upper notch 22 which is secured on an upper portion of the top sleeve 14 by a pin 221, a stretcher rib 23 having an upper end portion 231 of the stretcher rib 23 pivotally secured with the top rib 21 and a lower end portion 232 of the stretcher rib 23 pivotally secured with a lower runner 24 by a pin 241 which is slidably held in a pair of elongate slots 130 longitudinally formed in the outer tube 13, an intermediate rib 25 having an inner end portion of the intermediate rib 25 pivotally secured with a middle runner 26 and having an outer end portion of the intermediate rib 25 pivotally secured with an outer portion of the top rib 21, with the middle runner 26 secured on a top end portion 134 of the outer tube 13 by a pin 261.

As shown in FIGS. 1 and 6, the stretcher rib 23 is protruded upwardly through a slit 251 formed in the intermediate rib 25 from the lower runner 24 towards the top rib 21 for preventing a vibration especially when subjected to a wind blowing, thereby stabilizing the rib means 2 when opening the umbrella.

The umbrella-opening spring 3 has its lower spring end 31 retained on an upper portion 133 of the outer tube 13 and an upper spring end 32 retained on a bottom edge portion of the top sleeve 14.

The umbrella-closing spring 4 has its lower spring end 41 retained on a top end portion 115 of the inner tube 11 and an upper spring end 42 retained on a middle portion 132 of the outer tube 13.

The handle 12 includes: a central hole 121 for inserting a lower tube end portion 111 of the inner tube 11 into the central hole 121 to be connected with the handle 12. The top sleeve 14 is formed with a pair of elongate slots 141 for slidably engaging the pin 261 of the middle runner 26 in the slots 141.

The control means 5 includes: a push button 51 longitudinally slidably held in the handle 12 in a direction parallel to a longitudinal axis defined in the central shaft means 1, a lower control sleeve 52 juxtapositionally secured with the push button 51, a plug 53 slidably held in the inner tube 11 and connected with an upper control sleeve 54 which is laterally held with a sliding block 55 in the upper control sleeve 54 for operatively locking or unlocking the lower runner 24, a hook member 56 pivotally secured on the lower runner 24 to be operatively biased by the sliding block 55 for disengaging the hook member 56 from the outer tube 13 for releasing a spring energy of the umbrella-opening spring 3 for opening the umbrella, a resilient retainer 57 resiliently held in an upper portion of the upper control sleeve 54 having a protrusion 571 protruding outwardly through the protrusion hole 544 of the upper control sleeve 54 for engaging the protrusion hole 135 of the outer tube 13 for resiliently coupling the upper control sleeve 54 with the outer tube 13 as shown in FIG. 4, and a biasing lever 58 pivotally secured in the inner tube 11 normally coupling the outer tube 13 with the inner tube 11 for compressing the umbrella-closing spring 4 retained between the outer tube 13 and the inner tube 11, whereby upon a downwardly thrusting of the push button 51 to disengage the biasing lever 58 from the outer and inner tubes 13, 11 for uncoupling the outer and inner tubes for releasing the umbrella-closing spring 4 for closing the umbrella.

The umbrella-opening spring 3 is compressed for storing its spring energy when re-set from FIG. 4 to FIG. 1 ready for a next operation for opening the umbrella.

The push button 51 includes: a base plate 511 vertically slidably held in a vertical button hole 122 formed in a side portion of the handle 12, a lateral pin 512 protruding laterally through a pin slot 112 formed in the inner tube 11 to be connected with a lower tube end portion of the lower control sleeve 52, a resilient pawl 513 pivotally mounted in an upper inclinedly towards a center of the central shaft means 1, whereby upon an upwardly thrusting of the push button 51, the pawl 513 may be slid from the biasing lever 58 and upon a downwardly thrusting of the push button 51, the pawl 513 will depress the biasing lever 58 for closing the umbrella.

The lower control sleeve 52 is provided with a braking ball 522 on an upper portion 523 of the lower sleeve 52, resiliently urged sidewardly outwardly by a ball spring 522*a* for normally engaging a lower ball hole 114 in the inner tube 11 for coupling the lower control sleeve 52 and the inner tube 11.

The lower control sleeve 52 is formed with a rod hole 521 in a lower portion of the sleeve 52 on a first side A of the central shaft means 1, and formed with a hook hole 524 in an upper portion of the sleeve 52 on a second side B of the shaft means 1 for respectively engaging a lower and an upper portion of the biasing lever 58.

Figure 3:
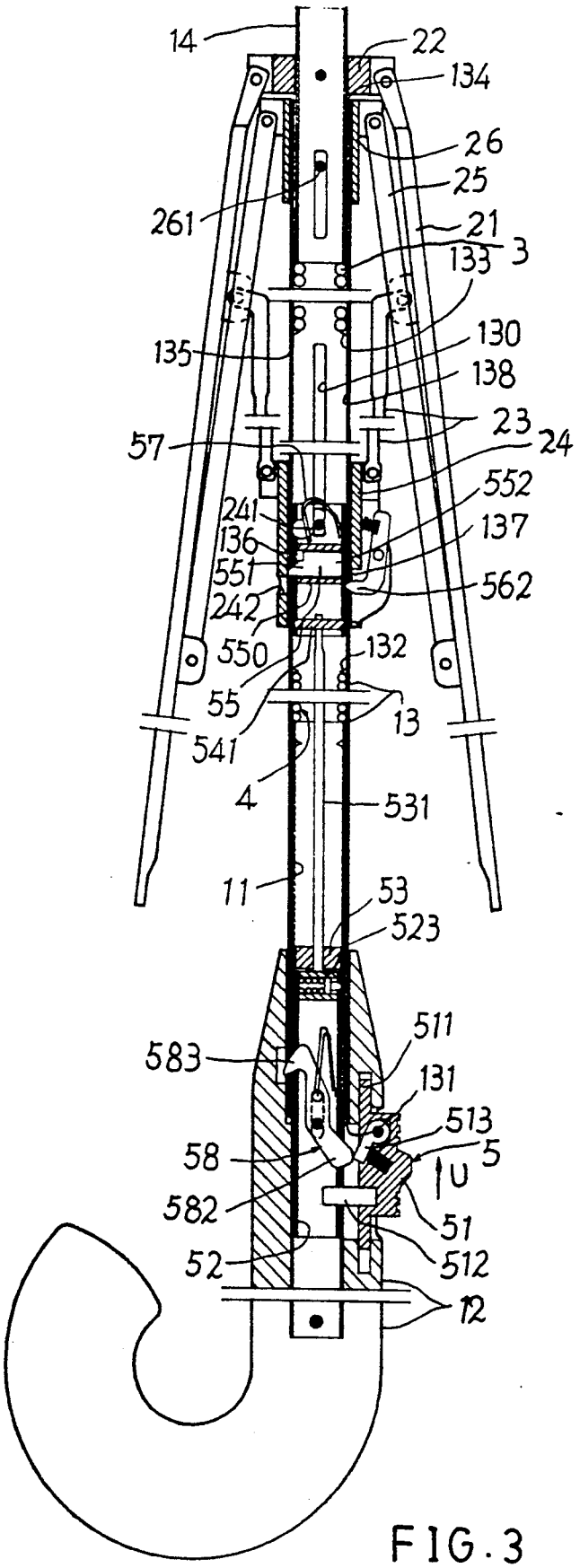
FIG. 3 is an instant illustration just ready for opening the umbrella from the status as shown in FIG. 2.

The plug 53 has a connecting rod 531 protruded upwardly from the plug 53 for connecting the upper control sleeve 54 with the rod 531. The plug 53 will be urged by a top end portion 523 of the lever control sleeve 54 for opening the umbrella as shown in FIG. 3, in which the plug 53 may be slidably pulled upwardly in the inner tube 11 to an upper end portion 115 of the inner tube 11 as shown in FIG. 4.

The upper control sleeve 54 includes a bottom portion 541 secured with a connecting rod 531 of the plug 53, a sliding guide 550 laterally formed in a middle portion of the upper control sleeve 54 for slidably holding the sliding block 55 in the sliding guide 550, a pair of guiding slots 543 vertically formed in an upper portion of the upper sleeve 54 for slidably holding the pin 241 of the lower runner 24, a first hook hole 542 formed in a lower portion of the upper sleeve 54 on a first side A of the central shaft means 1 adjacent to a first end of the sliding guide 550 and positioned below the sliding guide 550 for engaging a hook portion 562 of the hook member 56 as shown in FIG. 5, a protrusion hole 544 formed in an upper portion of the upper sleeve 54 on a second side B of the central shaft means 1 for engaging a protrusion 571 of the resilient retainer 57 retained on an upper portion of the upper sleeve 54, a locking hole 545 formed in a lower portion of the upper sleeve 54 below the protrusion hole 544 and formed in a second end of the sliding guide 550 for engaging a locking head portion 551 of the sliding block 55 of which the locking head portion 551 is tapered outwardly downwardly towards the second side B of the central shaft means 1.

The hook member 56 includes: a pivot 561 for pivotally mounting the hook member 56 in the lower runner 24, a hook portion 562 formed on a lower portion of the hook member 56 for respectively engaging an upper hook hole 138 and a lower hook hole 137 formed in the outer tube 13 and engaging a second hook hole 550*a* formed in the sliding guide 550 or engaging the first hook hole 542 in the upper sleeve 54, a hook tensioning spring 563 retaining an upper portion of the hook member 56 outwardly for biasing the hook portion 562 inwardly for respectively engaging the corresponding hook holes 137, 138, 542, 550*a*, so that the hook portion 562 may engage an upper hook hole 138 of the outer tube 13 as shown in FIG. 4 for opening the umbrella; or engage a lower hook hole 137 of the outer tube 13 as shown in FIG. 1 for closing the umbrella.

The biasing lever 58 includes: a lever pivot 581 for pivotally mounting the lever 58 in a lower portion of the inner tube 11 with the lever pivot 581 slidably engageable with a pair of pivot slots 525 formed in the lower control sleeve 52, an upper hook portion 583 protruding outwardly through a hook hole 524 formed in an upper portion of the lower sleeve 52 on a second side B of the central shaft means 1 and through an inner-tube hook hole 116 for engaging an outer hook hole 139 formed in the outer tube 13, a lower rod portion 582 formed on a lower portion of the lever 58 protruding outwardly through a first rod hole 521 in the lower sleeve 52, and a second rod hole 113 in the inner tube 11 towards a first side A of the central shaft means 1 to be operatively depressed by the pawl 513 of the push button 51 for inwardly retracting the upper hook portion 583 for operatively uncoupling the outer tube 13 from the inner tube 11 for closing the umbrella, and a lever spring 584 normally urging the upper hook portion 583 outwardly towards the second side B of the central shaft means 1 for operatively coupling the outer end inner tubes 13, 11.

Figure 2:
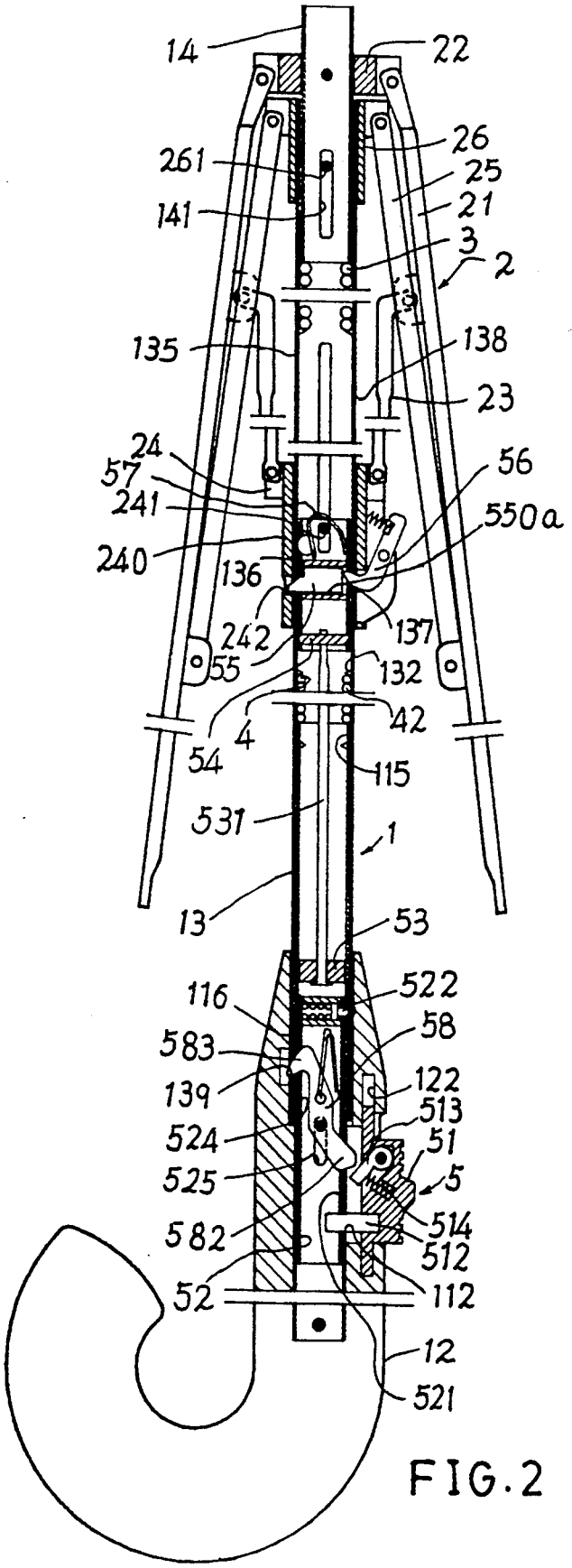
FIG. 2 shows a folded umbrella in which the umbrella-closing spring has been re-set.

When using the present invention for opening the umbrella, the folded umbrella as shown in FIG. 1 should be re-set by depressing the handle 12 for compressing the umbrella-closing spring 4 for storing its spring energy as shown in FIG. 2, and by thrusting the push button 51 upwardly (U) to allow the pawl 513 to pass by the lower rod portion 582 of the biasing lever 58 to be as shown in the instant state of FIG. 3 ready for opening the umbrella. Upon a continuous upwardly thrusting of the push button 51, the lower control sleeve 52 as coupled with the push button 51 by the pin 512 will be raised upwardly to allow the top end portion 523 of the lower sleeve 52 to push the plug 53, the upper control sleeve 54 upwardly to retract the locking head portion 551 of the sliding block 55 rightwardly to disengage the hook portion 562 of the hook member 56 from the hook hole 550*a*, thereby releasing the umbrella-opening spring 3 and urging the top sleeve 14, upper notch 22, top rib 21 and stretcher rib 23 upwardly for opening umbrella as shown in FIG. 4.

At this time, the hook portion 562 of the hook member 56 is engaged with the upper hook hole 138 after being disengaged from the lever hook hole 137. The protrusion 571 of the resilient retainer 57 of the upper sleeve 54 is engaged with the protrusion hole 135 of the outer tube 13 for enhancing a stable opening condition of the umbrella.

When closing the umbrella, the push button 51 is thrusted downwardly (D) as shown in FIG. 4 to allow the pawl 513 to urge the lower rod portion 582 of the lever 58 downwardly to bias the upper hook portion 583 inwardly to disengage the outer tube 13 from the inner tube 11, and the umbrella-closing spring 4 will eject the outer tube 13 upwardly to raise the middle runner 26, to downwardly pull the top rib 21 and the lower runner 24 to re-engage the hook portion 562 with the lever hook hole 137 for closing the umbrella as shown in FIG. 1. Meanwhile, the upper control sleeve 54 is also downwardly pulled by means of the pin 241 and the sliding block 55 is leftwardly urged by the hook member 56 as shown in FIG. 1 to engage the locking head portion 551 with the lower locking hole 136 of the outer tube 13 for stabilizing the folded umbrella.

During the folding process from FIGS. 4 to 1, a moving stroke of the umbrella-closing spring 4 from its compressed state to a released state is designed to be greatly larger than a moving stroke of the umbrella-opening spring 3 from its released state to a compressed state of the spring 3 and the overall elastic energy of the spring 4 should be larger than that of the spring 3 so that during the umbrella closing operation, the umbrella-opening spring 3 will be compressed to store its spring energy ready for next opening use.

From FIGS. 3 to 4, the plug 53 will be pulled upwardly by the lower runner 24 and the upper control sleeve 54 until the plug 53 is limited by an upper end portion 115 of the inner tube 11 as shown in FIG. 4.

The folded umbrella as shown in FIG. 1 has released a spring energy of the umbrella-closing spring 4 which should be re-set for storing its spring energy for next closing operation. Therefore, the handle 12 is depressed from FIGS. 1 to 2 to relatively compress the two tubes 13, 11 for compressing the spring 4 until engaging the upper hook portion 583 of lever 58 with the hook hole 139 for locking the two coupled tubes 13, 11.

The ball 522 as urged by spring 522*a* as shown in FIG. 1 will temporarily couple the lower control sleeve 52 with the inner tube 11 for a smooth engagement of the hook portion 583 with the hook hole 139 of the outer tube 13 when resetting and compressing the spring 4 and coupling the two tubes 13, 11 as shown in FIG. 2. Otherwise, a false moving of the push button 51 may also move the sleeve 52 and the lever 58, influencing a precise engagement operating as above-mentioned.

When the present umbrella is subjected to a downwardly acting wind pressure W as shown in FIGS. 1, 5, the wind pressure W will press the stretcher rib 23, the lower runner 24 and the hook portion 562 downwardly to engage the hook portion 562 into the hook hole 542 below the upper hook hole 550*a*, thereby still stabilizing an opened umbrella.

If the umbrella is subjected to an upwardly acting wind W1, the pin 261 of the middle runner 26 is fixed on a top end of the outer tube 13 for retaining the top sleeve 14, and a lower tube portion of the outer tube 13 is locked by the hook portion 583 so that the rib means 2 can not be upwardly pulled for helping a stable opening condition of the umbrella as shown in FIG. 4.

The present invention is superior to a conventional automatic umbrella with the following advantages:

1. An upwardly thrusting (U) of the push button 51 will open the umbrella, while a downwardly thrusting (D) of the button 51 will close the umbrella, thereby providing a logical operation sequence without causing confusion in opening or closing the umbrella.

2. A reliable mechanism is provided for enhancing a stable opening condition when unfolding the umbrella for use. Also, the control means 5 is well designed for preventing an unexpected false operation of the umbrella.

I claim:

1. An automatic umbrella comprising:

a central shaft means including: an inner tube, a handle secured with the inner tube, an outer tube slidably jacketed on the inner tube, and a top sleeve resiliently held in an upper portion of the outer tube;

an umbrella rib means including: a top rib having an inner end portion of the top rib pivotally secured on an upper notch which is secured on an upper portion of the top sleeve, a stretcher rib having an upper end portion of the stretcher rib pivotally secured with the top rib and a lower end portion of the stretcher rib pivotally secured with a lower runner slidably held in the outer tube, an intermediate rib having an inner end portion of the intermediate rib pivotally secured with a middle runner and having an outer end portion of the intermediate rib pivotally secured with an outer portion of the top rib, with the middle runner secured on a top end portion of the outer tube, said stretcher rib protruded upwardly through a slit formed in the intermediate rib from the lower runner towards the top rib for preventing a vibration of said rib means;

an umbrella-opening spring retained in between said outer tube and said top sleeve;

an umbrella-closing spring retained in between the inner tube and the outer tube; and a control means including: a push button longitudinally slidably held in the handle in a direction parallel to a longitudinal axis defined in the central shaft means, a lower control sleeve juxtapositionally secured with the push button, a plug slidably held in the inner tube and connected with an upper control sleeve which is laterally held with a sliding block in the upper control sleeve for operatively locking or unlocking the lower runner, a hook member pivotally secured on the lower runner to be operatively biased by the sliding block for disengaging the hook member from the outer tube for releasing a spring energy of the umbrella-opening spring for opening the umbrella, a resilient retainer resiliently held in an upper portion of the upper control sleeve having a protrusion protruding outwardly through the protrusion hole of the upper control sleeve for engaging the protrusion hole of the outer tube for resiliently coupling the upper control sleeve with the outer tube, and a biasing lever pivotally secured in the inner tube normally coupling the outer tube with the inner tube for compressing the umbrella-closing spring retained between the outer tube and the inner tube, whereby upon a downwardly thrusting of the push button to disengage the biasing lever from the outer and inner tubes for uncoupling the outer and inner tubes for releasing the umbrella-closing spring for closing the umbrella.

2. An automatic umbrella according to claim 1, wherein said push button includes: a base plate vertically slidably held in a vertical button hole formed in a side portion of the handle, a lateral pin protruding laterally through a pin slot formed in the inner tube to be connected with a lower tube end portion of the lower control sleeve, a resilient pawl pivotally mounted in an upper portion of the push button and normally restored downwardly inclinedly towards a center of the central shaft means, whereby upon an upwardly thrusting of the push button, the pawl will be slid from the biasing lever and upon a downwardly thrusting of the push button, the pawl will depress the biasing lever for closing the umbrella.

3. An automatic umbrella according to claim 2, wherein said biasing lever includes: a lever pivot for pivotally mounting the lever in a lower portion of the inner tube with the lever pivot slidably engageable with a pair of pivot slots formed in the lower control sleeve, an upper hook portion protruding outwardly through a hook hole formed in an upper portion of the lower sleeve on a second side of the central shaft means and through an inner-tube hook hole for engaging an outer hook hole formed in the outer tube, a lower rod portion formed on a lower portion of the lever protruding outwardly through a first rod hole in the lower sleeve, and a second rod hole in the inner tube towards a first side of the central shaft means to be operatively depressed by the pawl of the push button for inwardly retracting the upper hook portion for operatively uncoupling the outer tube from the inner tube for closing the umbrella, and a lever spring normally urging the upper hook portion outwardly towards the second side of the central shaft means for operatively coupling the outer end inner tubes.

4. An automatic umbrella according to claim 1, wherein said lower control sleeve is provided with a braking ball on an upper portion of the lower sleeve, resiliently urged sidewardly outwardly by a ball spring for normally engaging a lower ball hole in the inner tube for coupling the lower control sleeve and the inner tube.

5. An automatic umbrella according to claim 1, wherein said upper control sleeve includes a bottom portion secured with a connecting rod of the plug, a sliding guide laterally formed in a middle portion of the upper control sleeve for slidably holding the sliding block in the sliding guide, a pair of guiding slots vertically formed in an upper portion of the upper sleeve for slidably holding the pin of the lower runner, a first hook hole formed in a lower portion of the upper sleeve on a first side of the central shaft means adjacent to a first end of the sliding guide and positioned below the sliding guide for engaging a hook portion of the hook member, a protrusion hole formed in an upper portion of the upper sleeve on a second side of the central shaft means for engaging a protrusion of the resilient retainer retained on an upper portion of the upper sleeve, a locking hole formed in a lower portion of the upper sleeve below the protrusion hole and formed in a second end of the sliding guide for engaging a locking head portion of the sliding block of which the locking head portion is tapered outwardly downwardly towards the second side of the central shaft means.

6. An automatic umbrella according to claim 1, wherein said hook member includes: a pivot for pivotally mounting the hook member in the lower runner, a hook portion formed on a lower portion of the hook member for respectively engaging an upper hook hole and a lower hook hole formed in the outer tube and engaging a second hook hole formed in the sliding guide or engaging the first hook hole in the upper sleeve, a hook tensioning spring retaining an upper portion of the hook member outwardly for biasing the hook portion inwardly for engaging a corresponding hook hole, so that the hook portion will engage an upper hook hole of the outer tube for opening the umbrella; or engage a lower hook hole of the outer tube for closing the umbrella.

* * * * *